US008382094B2

(12) United States Patent
Hayakawa et al.

(10) Patent No.: US 8,382,094 B2
(45) Date of Patent: Feb. 26, 2013

(54) RECORDING MEDIUM FEEDING DEVICE AND IMAGE FORMING APPARATUS

(75) Inventors: Yuji Hayakawa, Kanagawa (JP); Yasuhiro Kurokawa, Kanagawa (JP); Teruki Naganuma, Kanagawa (JP)

(73) Assignee: Fuji Xerox Co., Ltd., Tokyo (JP)

( * ) Notice: Subject to any disclaimer, the term of this patent is extended or adjusted under 35 U.S.C. 154(b) by 14 days.

(21) Appl. No.: 13/271,702

(22) Filed: Oct. 12, 2011

(65) Prior Publication Data

US 2012/0242030 A1 Sep. 27, 2012

(30) Foreign Application Priority Data

Mar. 25, 2011 (JP) ..... 2011-068462

(51) Int. Cl.
*B65H 5/00* (2006.01)
*B65H 3/06* (2006.01)

(52) U.S. Cl. ..... 271/10.13; 271/114; 271/10.04; 271/10.05; 271/116

(58) Field of Classification Search ..... 271/10.13, 271/114, 116, 10.04, 10.05
See application file for complete search history.

(56) References Cited

U.S. PATENT DOCUMENTS 3,961,786 A * 6/1976 Yanker ..... 271/122
5,085,420 A * 2/1992 Sata ..... 271/114
5,405,128 A 4/1995 Fujiwara et al.
7,931,265 B2 4/2011 Okamoto
2009/0200729 A1 8/2009 Okamoto

FOREIGN PATENT DOCUMENTS

| | | |
|---|---|---|
| JP | A-05-024691 | 2/1993 |
| JP | A-05-032332 | 2/1993 |
| JP | A-06-100191 | 4/1994 |
| JP | A-2003-063673 | 3/2003 |
| JP | B2-4438872 | 3/2010 |

* cited by examiner

*Primary Examiner* — Luis A Gonzalez

(74) *Attorney, Agent, or Firm* — Oliff & Berridge, PLC

(57) ABSTRACT

A recording medium feeding device includes a first rotating member picking up a recording medium, a second rotating member transporting the picked-up recording medium, a driving gear unit rotating and transmitting a driving force, a first transmission mechanism having a first gear and transmitting the driving force in a first rotation direction to the first rotating member and the second rotating member, a second transmission mechanism having a second gear and transmitting the driving force in a second rotation direction to the first rotating member, and a transmission adjusting portion transmitting the driving force of either one of the first or second gear to either one of the first or second transmission mechanism, wherein the first gear rotates in the first rotation direction, the second gear rotates in the second rotation direction, and the driving gear unit engages with both the first and second gear within a predetermined range.

10 Claims, 8 Drawing Sheets

RECORDING MEDIUM FEEDING DEVICE AND IMAGE FORMING APPARATUS

CROSS-REFERENCE TO RELATED APPLICATIONS

This application is based on and claims priority under 35 USC 119 from Japanese Patent Application No. 2011-068462 filed Mar. 25, 2011.

BACKGROUND

Technical Field

The present invention relates to a recording medium feeding device and an image forming apparatus.

SUMMARY

According to an aspect of the invention, there is provided a recording medium feeding device including: a first rotating member that picks up a recording medium; a second rotating member that transports the recording medium picked up by the first rotating member; a driving gear unit that rotates and transmits a driving force; a first transmission mechanism that includes a first gear, wherein, when the driving force of the driving gear unit is transmitted, the first transmission mechanism transmits the driving force in a first rotation direction to the first rotating member and the second rotating member; a second transmission mechanism that includes a second gear, wherein, when the driving force of the driving gear unit is transmitted, the second transmission mechanism transmits the driving force in a second rotation direction, which is opposite to the first rotation direction, to the first rotating member; and a transmission adjusting portion that transmits a rotation of either one of the first gear or the second gear to either one of the first transmission mechanism or the second transmission mechanism as the driving force, wherein the first gear rotates in the first rotation direction when the first gear engages with the driving gear unit, the second gear rotates in the second rotation direction when the second gear engages with the driving gear unit, and the driving gear unit engages so as to overlap with both the first gear and the second gear within a predetermined range.

BRIEF DESCRIPTION OF THE DRAWINGS

Exemplary embodiments of the present invention will be described in detail based on the following figures, wherein.

DETAILED DESCRIPTION

First Exemplary Embodiment

Figure 1:
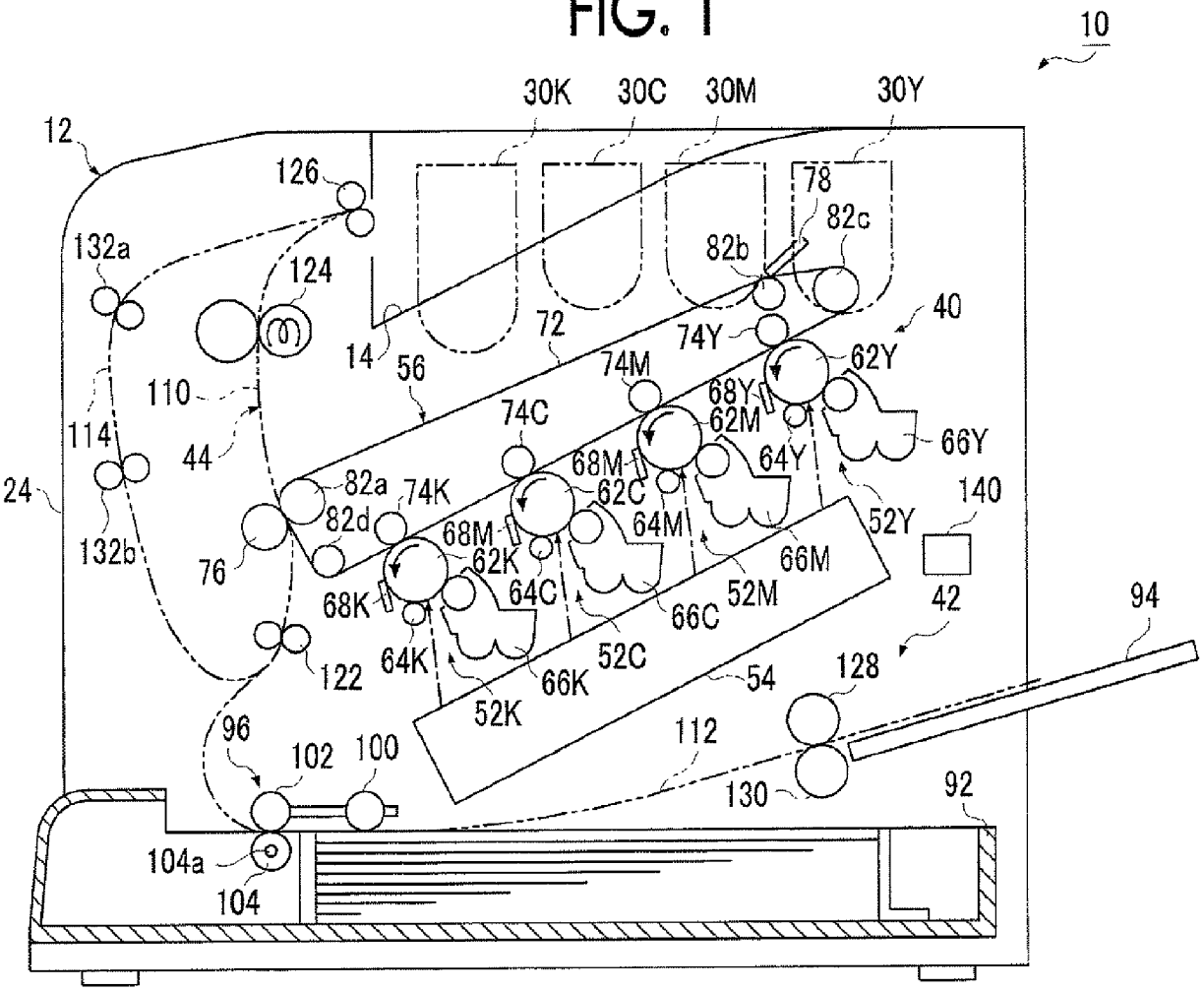
FIG. 1 is a sectional view illustrating an image forming apparatus according to a first exemplary embodiment of the invention.

A first exemplary embodiment of the invention will be described with reference to the accompanying drawings. FIG. 1 shows a sectional view of an image forming apparatus 10 according to the first exemplary embodiment of the invention.

The image forming apparatus 10 has an image forming apparatus body 12 and the top of the image forming apparatus body 12 serves as a discharge section 14 to which a recording medium having an image formed thereon is discharged.

Containers 30Y, 30M, 30C, and 30K are demountably mounted on the image forming apparatus body 12.

Toner of yellow (Y), toner of magenta (M), toner of cyan (C), and toner of black (K) used as image forming agents are contained in the containers 30Y, 30M, 30C, and 30K, respectively.

The containers 30Y, 30M, and 30C having the same shape and size and contain substantially the same volume of toner. The container 30K is vertically longer than the containers 30Y, 30M, and 30C and has a volume larger than those of the containers 30Y, 30M, and 30C and thus the volume of the toner contained therein is larger than those of the containers 30Y, 30M, and 30C.

The containers 30Y, 30M, and 30C and the container 30K are different in the volume of the toner contained therein from each other, but having the same members and functions.

The image forming apparatus body 12 includes an image forming section 40, a recording medium feeding device 42 feeding a recording medium to the image forming section 40, and a transporting path 44 used to transport the recording medium.

The image forming section 40 includes, for example, four image forming units 52Y, 52M, 52C, and 52K, a latent image forming device 54, and a transfer device 56. The image forming units 52Y, 52M, 52C, and 52K form developer images using color toner of Y, M, C, and K, respectively.

Hereinafter, the image forming units 52Y, 52M, 52C, and 52K may be generically referred to as the "image forming units 52" by not attaching Y, M, C, and K corresponding to the colors. This is true of the other elements (the containers 30, the photosensitive drums 62, and the like) corresponding to the colors.

Each of the image forming units 52 includes a photosensitive drum 62 used as an image holding member, a charging device 64 charging the photosensitive drum 62, a developing device 66 developing an electrostatic latent image formed on the surface of the photosensitive drum 62, and a cleaning device 68 cleaning the surface of the photosensitive drum 62.

The developing device 66 develops the electrostatic latent image formed on the surface of the photosensitive drum 62 by the latent image forming device 54 with toner to form a toner image.

The developing devices 66 are supplied with the corresponding color toner from the containers 30.

The transfer device 56 includes a belt-like intermediate transfer member 72 used as a transfer medium, primary transfer rolls 74Y, 74M, 74C, and 74K used as a primary transfer device, a secondary transfer roll 76 used as a secondary transfer device, and a cleaning device 78 cleaning the surface of the intermediate transfer member 72.

The toner images formed on the photosensitive drums 62 are transferred to the intermediate transfer member 72 so as to overlap with each other. The intermediate transfer member 72 is rotatably supported, for example, by four support rolls 82*a*, 82*b*, 82*c*, and 82*d* used as a support member.

At least one of the support rolls 82*a*, 82*b*, 82*c*, and 82*d* is connected to a drive source (not shown) such as a motor and rotates with the driving force from the drive source to rotationally drive the intermediate transfer member 72.

The support roll 82*a* is disposed to face the secondary transfer roll 76 and serves as a backup roll of the secondary transfer roll 76.

The primary transfer rolls 74Y, 74M, 74C, and 74K transfer the color toner images corresponding to the respective colors formed on the photosensitive drums 62Y, 62M, 62C, and 62K to the intermediate transfer member 72.

The secondary transfer roll 76 transfers the color toner images transferred to the intermediate transfer member 72 to a recording medium.

The recording medium feeding device 42 includes a recording medium container 92 on which recording media are stacked, a recording medium tray 94 such as a manual input tray, and a recording medium transporting unit 96 transporting the recording media contained in the recording medium container 92 and the recording medium placed on the recording medium tray 94.

The recording medium container 92 is configured to be drawn out to the front side (the left side in FIG. 1) of the image forming apparatus body 12 and recording media are supplied in a state where it is drawn out from the image forming apparatus body 12.

The recording medium tray 94 is used to set a special medium other than the recording media contained in the recording medium container 92, such as a postcard or heavy paper.

The recording medium transporting unit 96 includes a pickup roll 100 and a transport roll 102.

The pickup roll 100 is used as the first rotating member and picks up the uppermost recording medium contained in the recording medium container 92.

The transport roll 102 is used as the second rotating member and transports the recording medium picked up by the pickup roll 100 to the image forming section 40. A separation roll 104 is disposed to come in contact with the transport roll 102. The separation roll 104 separates the recording media between the transport roll 102 and the separation roll 104.

The separation roll 104 is provided with a rotation control member (one-way torque limiter) 104*a*.

The rotation control member 104*a* generates a rotational force (torque) in a direction in which a recording medium is transported to the image forming section 40 and cuts off the transmission of the rotational force when a force greater than a predetermined rotational force acts thereon. Regarding the reverse rotation, the rotation control member 104*a* does not generate a rotational force but rotates in an idle state.

The transporting path 44 includes a main transporting path 110, a feeding path 112, and an inverse transporting path 114.

The main transporting path 110 is a transporting path through which the recording medium fed from the recording medium feeding device 42 is transported to the discharge section 14. A transport roll 102, a separation roll 104, a register roll 122, a secondary transfer roll 76, a fixing device 124, and a discharge roll 126 are disposed in the main transporting path 110 sequentially from the upstream in the recording medium transporting direction.

The register roll 122 starts its rotation at a predetermined time from a stopped state and feeds the recording medium to the contact portion between the intermediate transfer member 72 and the secondary transfer roll 76 at the time of transferring the toner images to the intermediate transfer member 72.

The fixing device 124 fixes the toner images to the recording medium to which the toner images are transferred by the transfer device 56.

The discharge roll 126 discharges the recording medium to which the toner images are fixed by the fixing device 124 to the discharge section 14. When images are formed on both surfaces of a recording medium, the discharge roll 126 rotates in the opposite direction to the direction in which the recording medium is discharged to the discharge section 14 and transports the recording medium having an image formed on one surface thereof from the trailing edge thereof to the inverse transporting path 114.

The feeding path 112 is a transporting path through which the recording medium placed on the recording medium tray 94 is fed to the transport roll 102. The feeding path 112 is formed to pass through between the pickup roll 100 and the recording medium to be picked up by the pickup roll 100.

A feed roll 128 transporting the recording medium to the transport roll 102 and a feed separation roll 130 coming in contact with the feed roll 128 to separate the recording medium are disposed in the feeding path 112.

The inverse transporting path 114 is a transporting path used to invert the recording medium having an image formed on one surface thereof and to transport the recording medium more upstream than the register roll 122. For example, two inverse transport rolls 132*a* and 132*b* are disposed in the inverse transporting path 114.

The image forming apparatus body 12 includes a controller 140 used as a control unit controlling the constituent elements of the image forming apparatus 10.

Details of the recording medium transporting unit 96 will be described below.

Figure 2:
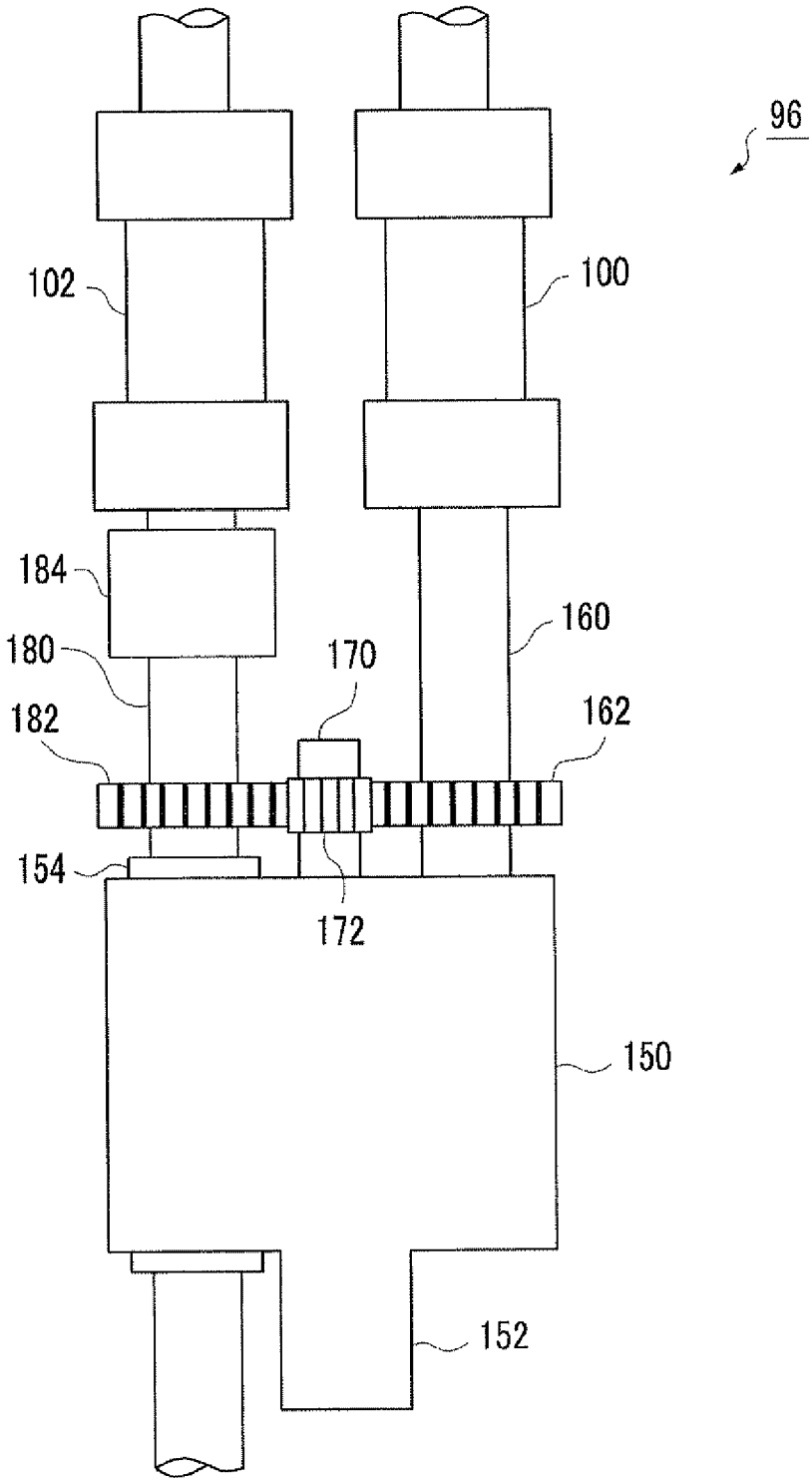
FIG. 2 is a diagram schematically illustrating a pickup roll and a transport roll of a recording medium transporting section according to the first exemplary embodiment of the invention and the peripheral structure thereof.

FIG. 2 is a diagram schematically illustrating the pickup roll 100 and the transport roll 102 of the recording medium transporting unit 96 and the peripheral structure thereof.

Hereinafter, regarding the pickup roll 100, the transport roll 102, and the constituent elements related to the driving thereof, the rotation direction in which a recording medium is transported to the image forming section 40 is defined as the first rotation direction (normal rotation) and the rotation direction opposite to the first rotation direction is defined as the second rotation direction (reverse rotation).

The recording medium transporting unit 96 includes a revolving member 150 and a pressing target portion 152 is formed in the revolving member 150. The revolving member 150 is rotatably supported by a support portion 154.

The revolving member 150 is configured to revolve about the axis coaxial with a transport rotation shaft 180 to be described later.

A pickup rotation shaft 160 is rotatably disposed on the side of the revolving member 150 opposite to the supporting portion 154. A pickup roll 100 and a pickup gear 162 are disposed in the pickup rotation shaft 160.

When the pickup gear 162 rotates, the pickup roll 100 rotates along with the pickup rotation shaft 160.

An idle rotation shaft (idler shaft) 170 is disposed in the revolving member 150 and an idle gear (idler gear) 172 is rotatably disposed in the idle rotation shaft 170.

The idle gear 172 engages with the pickup gear 162. The idle gear 172 engages with a transport gear 182 disposed in the transport rotation shaft 180.

The pickup rotation shaft 160 and the idle rotation shaft 170 revolve with the revolution of the revolving member 150.

For example, with the revolution of the revolving member 150 in the direction in which it gets away from the feeding path 112, the pickup roll 100 moves in the direction in which it gets away from the feeding path 112 in the state where the pickup rotation shaft 160, the idle rotation shaft 170, and the transport rotation shaft 180 maintain their relative positional relationship.

The transport roll 102 is disposed in the transport rotation shaft 180 with a transmission cutoff portion 184 interposed therebetween.

The transmission cutoff portion 184 is constructed, for example, by a one-way clutch and cuts off the transmission of the rotational force in the other direction, where the rotation direction in which the rotational force is transmitted to the transport roll 102 is defined as one direction.

In this exemplary embodiment, the transmission cutoff portion 184 transmits the rotational driving force to the transport roll 102 when the transport rotation shaft 180 normally rotates, and cuts off the transmission of the rotational driving force to the transport roll 102 when the transport rotation shaft 180 reversely rotates.

In this way, the transport roll 102 is configured to rotate with the driving force at the time of normal rotation and to idle at the time of reverse rotation.

A driving mechanism 200 driving the recording medium transporting unit 96 will be described below.

Figure 3:
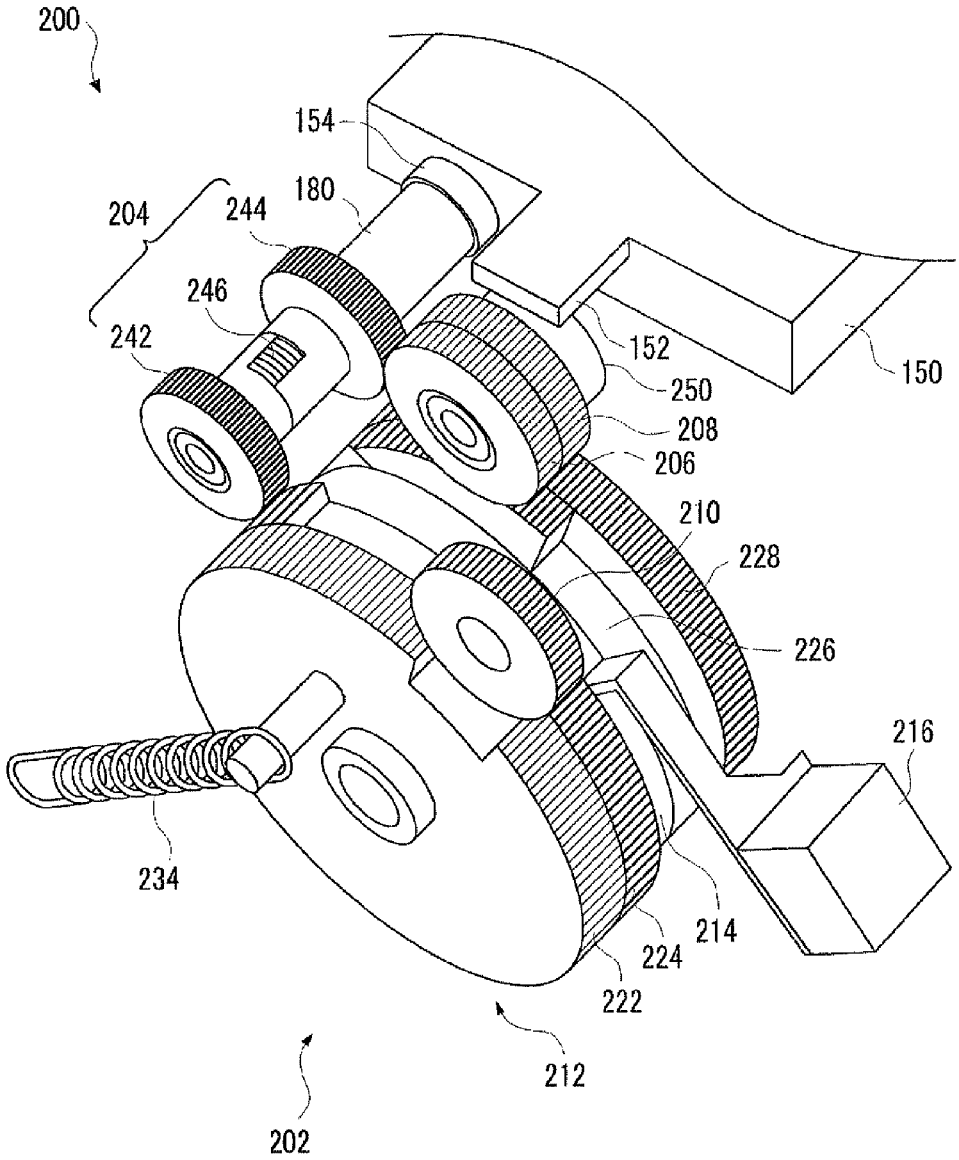
FIG. 3 is a perspective view illustrating a driving mechanism according to the first exemplary embodiment of the invention.

FIG. 3 is a perspective view of the driving mechanism 200.

Figure 4:
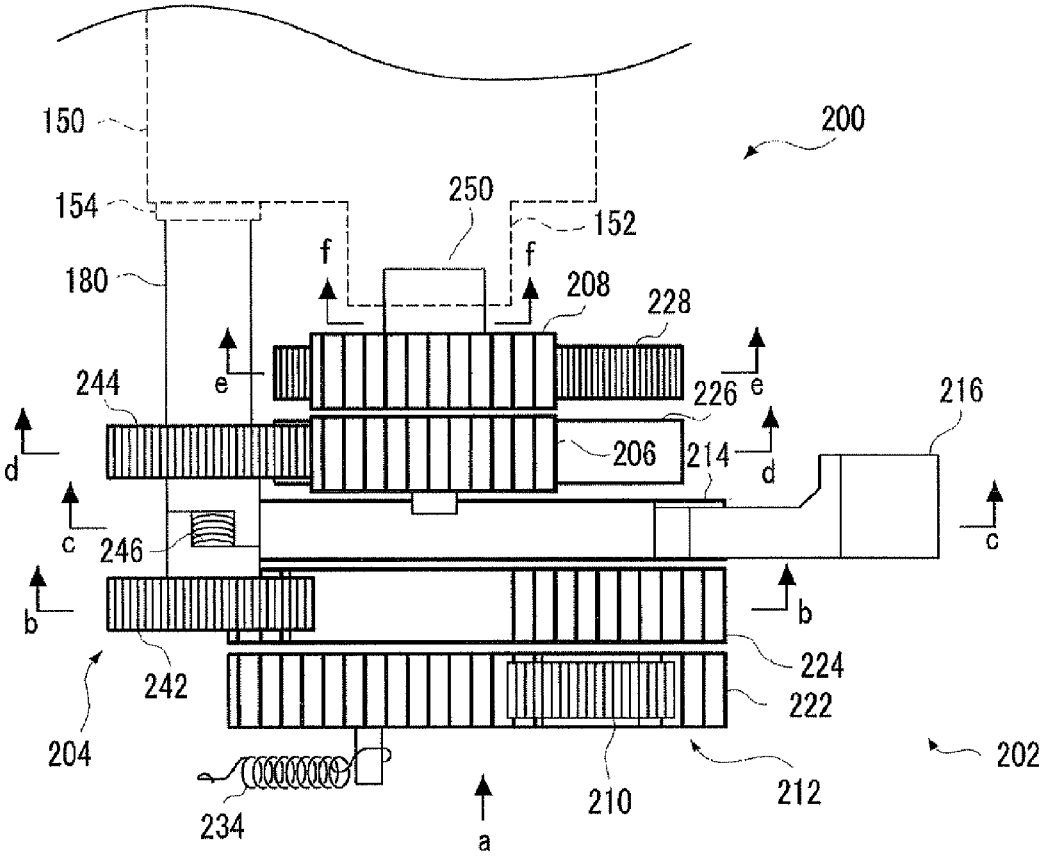
FIG. 4 is a top view illustrating the driving mechanism according to the first exemplary embodiment of the invention.

FIG. 4 is a top view of the driving mechanism 200.

FIGS. 5A to 5F are diagrams illustrating the structure of the driving mechanism 200.

The recording medium transporting unit 96 is provided with the driving mechanism 200 driving the pickup roll 100 and the transport roll 102.

The driving mechanism 200 includes a driving gear unit 202, a driven gear unit 204, an idle driving gear 206, and a separation gear 208.

The driving gear unit 202 includes an input gear 210 being connected to a drive source such as a motor and normally rotating, a driving gear group 212, a rotation-regulated portion 214, and a rotation-regulating portion 216 such as a solenoid.

The driving gear group 212 and the rotation-regulated portion 214 rotate as a single body. By causing the rotation of the rotation-regulated portion 214 to be regulated by the rotation-regulating portion 216, the rotation of the driving gear group 212 is regulated along with the rotation-regulated portion 214.

The driving gear group 212 includes a first driving gear 222, a second driving gear 224, a third driving gear 226, and a fourth driving gear 228, which are tooth-missed gears not having a toothed portion in a predetermined range thereof.

The first driving gear 222 is provided with an impelling member 234 and the impelling member 234 impels the first driving gear 222 in the second rotation direction.

When the regulation of the rotation-regulating portion 216 is released, the driving gear group 212 and the rotation-regulated portion 214 reversely rotate with the impelling force of the impelling member 234.

The driven gear unit 204 is disposed in the transport rotation shaft 180 and includes a first driven gear 242, a second driven gear 244, and a buffer portion 246 formed of an elastic member such as a spring.

The first driven gear 242 rotates about the transport rotation shaft 180.

The first driven gear 242 is fixed to the transport rotation shaft 180 and the transport rotation shaft 180 rotates with the rotation of the first driven gear 242.

The second driven gear 244 is connected to the first driven gear 242 with the buffer portion 246 interposed therebetween.

The buffer portion 246 is configured to follow the, rotation of the second driven gear 244 and impels the first driven gear 242 in the second rotation direction.

The buffer portion 246 is used as a transmission adjusting portion and serves to form a mechanism margin (gap) between the first driven gear 242 and the second driven gear 244.

Accordingly, the first driven gear 242 and the second driven gear 244 can simultaneously rotate in the opposite directions within the range in which the transmission of the rotational force to each other is buffered by the buffer portion 246 (for example, the range corresponding to two or three teeth).

For example, when the second driven gear 244 reversely rotates but the first driven gear 242 normally rotates, the second driven gear 244 is configured to maintain the reverse rotation by a predetermined number of rotation times so as to shrink the buffer portion 246.

The second driven gear 244 may be fixed to the transport rotation shaft 180 and the transport rotation shaft 180 may rotate with the rotation of the second driven gear 244. In this case, the buffer portion 246 is disposed to follow the rotation of the first driven gear 242 and impels the second driven gear 244 in the first rotation direction.

Figure 5A:
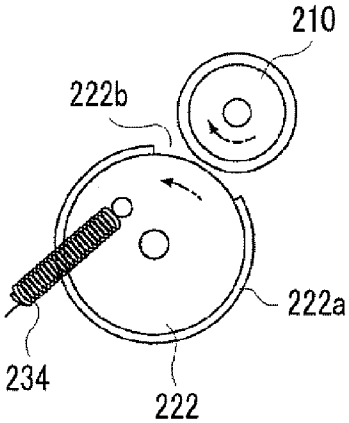
FIGS. 5A to 5F are diagrams illustrating the structure of the driving mechanism according to the first exemplary embodiment of the invention.
Figure 5B:
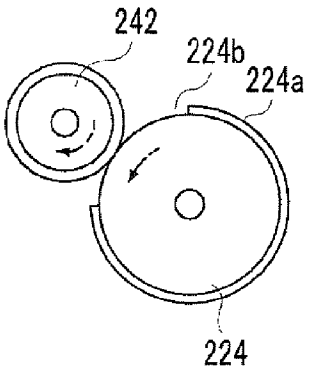
Figure 5C:
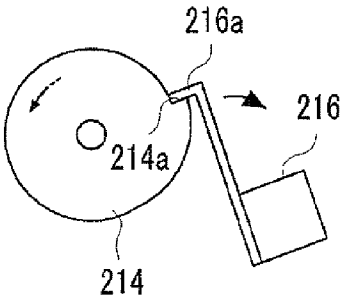
Figure 5D:
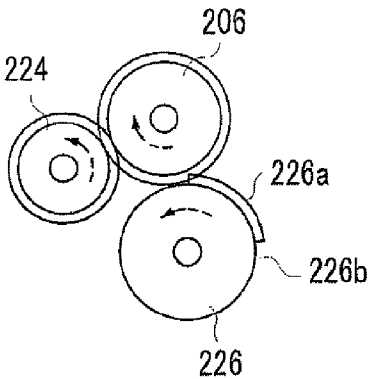
Figure 5E:
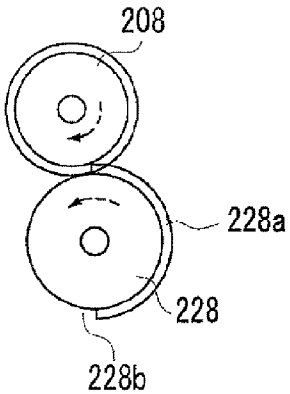

The separation gear 208 includes a pressing portion 250 constructed by a cam having a non-uniform distance from the rotation shaft to an end in the normal direction (see FIG. 5E). The pressing portion 250 is disposed in the rotation shaft direction of the separation gear 208 and rotates with the rotation of the separation gear 208.

The pressing portion 250 is disposed to face the pressing target portion 152 of the revolving member 150 and is configured to press the pressing target portion 152 when the tip 250*a* of the pressing portion 250 faces the pressing target portion 152.

In this way, the pressing portion 250 presses the pressing target portion 152 in a predetermined range with the rotation of the separation gear 208, whereby the revolving member 150 revolves about the supporting portion 154.

The pressing portion 250 causes the revolving member 150 having the pickup roll 100 to revolve so that the pickup roll 100 does not interfere with the traveling path of a recording medium passing through the feeding path 112.

The details of the structure of the driving mechanism 200 will be described below.

FIG. 5A shows a schematic sectional view taken along line a-a of FIG. 4. The structure of the deeper side than the first driving gear 222 will not be shown.

The first driving gear 222 includes a toothed portion 222*a* and a tooth-missed portion 222*b*.

The first driving gear 222 does not transmit the driving force of the input gear 210 when the tooth-missed portion 222*b* faces the input gear 210.

When the first driving gear 222 rotates in the second rotation direction with the impelling force of the impelling member 234, the toothed portion 222*a* of the first driving gear 222 engages with the input gear 210 to transmit the driving force to the first driving gear 222.

Accordingly, the driving gear group 212 reversely rotates with the driving force.

FIG. 5B is a schematic sectional view taken along line b-b of FIG. 4.

The second driving gear 224 includes a toothed portion 224*a* and a tooth-missed portion 224*b* and is disposed to face the first driven gear 242.

The first driven gear 242 is configured to normally rotate when it engages with the toothed portion 224*a*.

FIG. 5C is a schematic sectional view taken along line c-c of FIG. 4. The driven gear 204 is not shown.

The rotation-regulated portion 214 includes a locked portion 214*a* and the locking portion 216*a* of the rotation-regulating portion 216 is locked to the locked portion 214*a* whereby the rotation of the rotation-regulated portion 214 is regulated.

When the rotation-regulating portion 216 is driven to release the locking of the locking portion 216*a*, the rotation-regulated portion 214 is rotatable.

FIG. 50 is a schematic sectional view taken along line d-d of FIG. 4.

The third driving gear 226 includes a toothed portion 226*a* and a tooth-missed portion 226*b* and is disposed to face the idle driving gear 206.

The idle driving gear 206 is configured to normally rotate when it engages with the toothed portion 226*a*.

On the other hand, the idle driving gear 206 is configured to engage with the second driven gear 244. Accordingly, the second driven gear 244 is configured to reversely rotate in the direction opposite to the idle driving gear 206, when the idle driving gear 206 normally rotates.

FIG. 5E is a schematic sectional view taken along line e-e of FIG. 4.

The fourth driving gear 228 includes a toothed portion 228*a* and a tooth-missed portion 228*b* and is disposed to face the separation gear 208.

The separation gear 208 is configured to normally rotate when it engages with the toothed portion 228*a*.

Figure 5F:
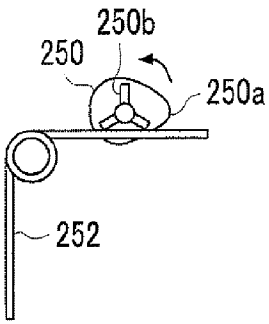

FIG. 5F is a schematic sectional view taken along line f-f of FIG. 4. The structure of the deeper side than the pressing portion 250 is not shown.

A positioning portion 252 formed of, for example, a spring is disposed in the pressing portion 250.

The positioning portion 252 comes in contact with the positioning target portion 250*b* of the pressing portion 250 and positions the pressing portion 250 at the initial position.

Specifically, after the pressing portion 250 presses the pressing target portion 152 and further rotates, the separation gear 208 faces the tooth-missed portion 228*b* of the fourth driving gear 228. When the separation gear 208 is made to be freely rotatable, the pressing portion 250 moves to the initial position with the impelling force of the positioning portion 252.

In this exemplary embodiment, the initial position is a position where the tip 250*a* of the pressing portion 250 is located in the substantially horizontal direction and does not contact with the pressing target portion 152.

The function of the recording medium transporting unit 96 will be described below.

FIGS. 6A to 6F are diagrams illustrating the operation of the recording medium transporting unit 96.

Figure 7:
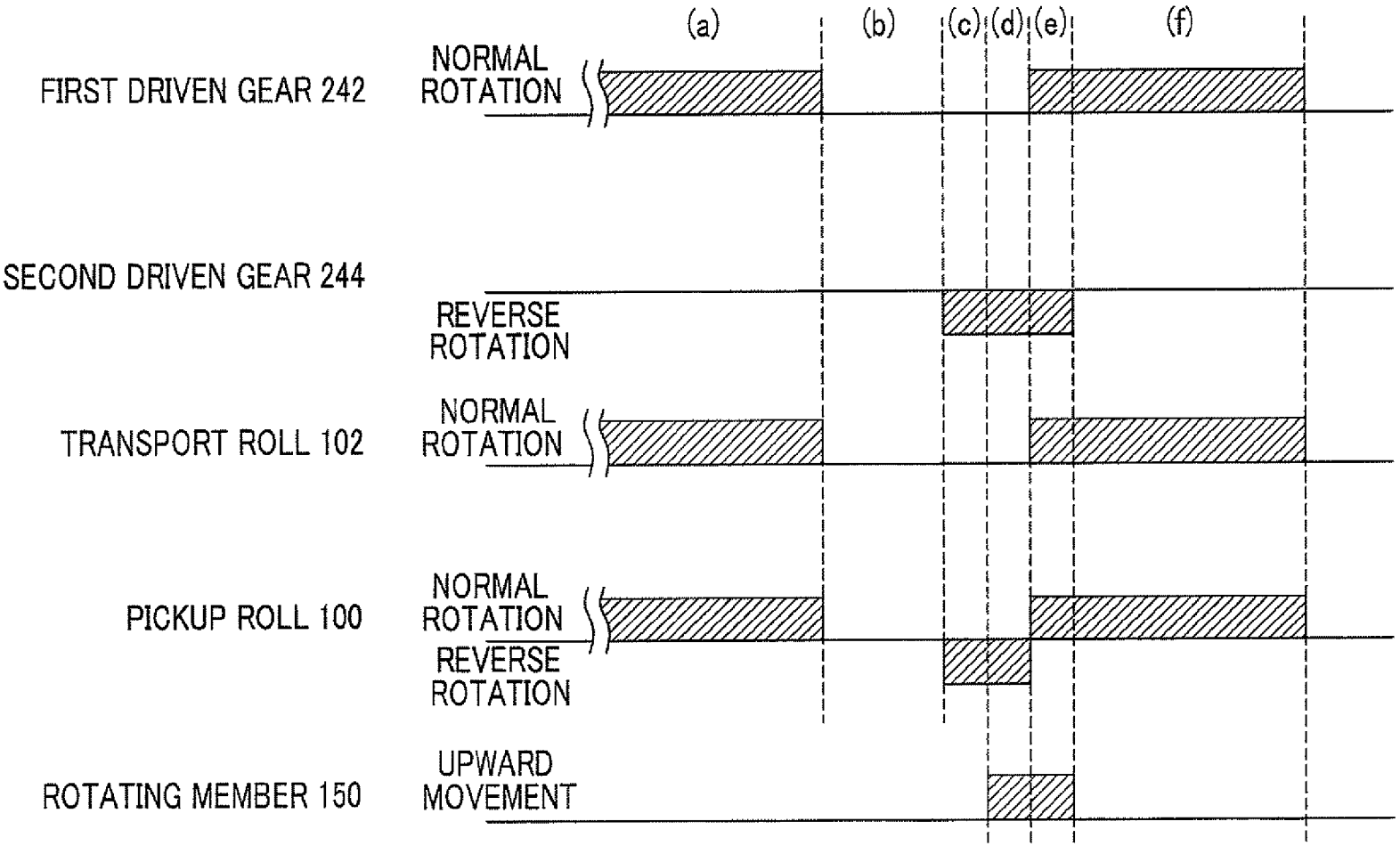
FIG. 7 is a diagram illustrating operation states of the elements of the recording medium transporting section according to the first exemplary embodiment of the invention.

FIG. 7 is a diagram illustrating operating states of the constituent elements of the recording medium transporting unit 96.

An example where the recording medium transporting unit first transports a recording medium contained in the recording medium container 92 of the recording medium feeding device 42 and then transport a recording medium placed on the recording medium tray 94.

Figure 6A:
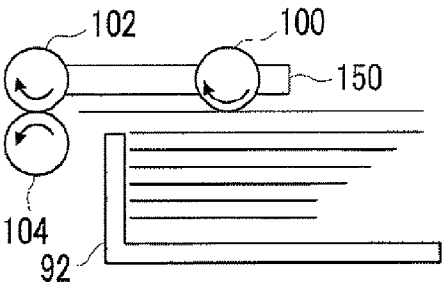
FIGS. 6A to 6F are diagrams illustrating the operation of a recording medium transporting section according to the first exemplary embodiment of the invention.

As shown in FIG. 6A and (a) of FIG. 7, in the state where a recording medium is being transported, the pickup roll 100, the transport roll 102, and the separation roll 104 normally rotate.

Specifically, the second driving gear 224 and the first driven gear 242 of the driving mechanism 200 engage with each other and the first driven gear 242 normally rotates.

Accordingly, the transport rotation shaft 180 normally rotates and the transport roll 102 normally rotates.

With the normal rotation of the transport rotation shaft 180, the pickup rotation shaft 160 normally rotates along with the transport gear 182, the idle gear 172, and the pickup gear 162. Accordingly, the pickup roll 100 normally rotates.

In this way, the uppermost recording medium in the recording medium container 92 is picked up by the pickup roll 100 and is transported to the image forming section 40 by the transport roll 102.

Figure 6B:
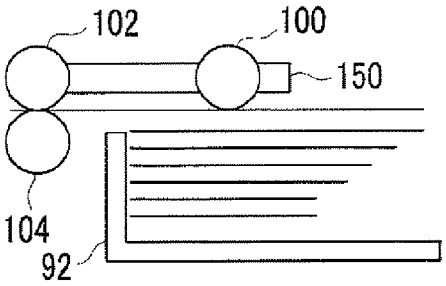

As shown in FIG. 6B and (b) of FIG. 7, when the transport of a predetermined number of recording media is finished, the rotations of the pickup roll 100, the transport roll 102, and the separation roll 104 are stopped.

Specifically, the rotation-regulating portion 216 of the driving mechanism 200 regulates the rotation of the rotation-regulated portion 214 and the rotation of the driving gear group 212 is stopped. Accordingly, the rotation of the first driven gear 242 is stopped and the rotation of the transport rotation shaft 180 is stopped.

At this time, the uppermost recording medium contained in the recording medium container 92 may not be positioned at a regular position in the recording medium container 92, that is, the uppermost recording medium may stay pinched between the transport roll 102 and the separation roll 104. The recording medium positioned at the regular position may interfere with the transport of a subsequent recording medium.

The regular position in this exemplary embodiment means a normal position when the recording medium contained in the recording medium container 92 is picked up by the pickup roll 100 (for example, the position before the recording medium is picked up by the pickup roll 100).

Subsequently, the transport of the recording medium placed on the recording medium tray 94 is started.

Figure 6C:
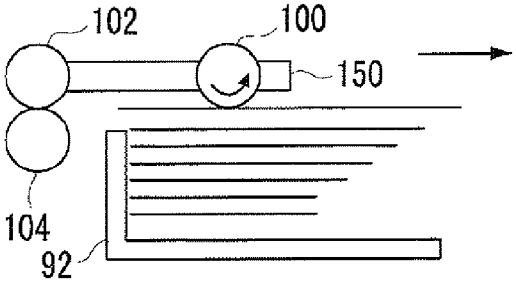

As shown in FIG. 6C and (c) of FIG. 7, when the transport of the recording medium is started in the state where the rotations of the pickup roll 100, the transport roll 102, and the separation roll 104 are stopped, the pickup roll 100 first reversely rotates. Accordingly, the recording medium not positioned at the regular position is made to move to the regular position.

Specifically, when the rotation-regulating portion 216 of the driving mechanism 200 releases the regulation of the rotation of the rotation-regulated portion 214, the driving gear group 212 reversely rotates with the driving force of the input gear 210.

Accordingly, the third driving gear 226 engages with the idle driving gear 206 and the idle driving gear 206 engages with the second driven gear 244. As a result, the second driven gear 244 reversely rotates.

When the second driven gear 244 reversely rotates, the transport rotation shaft 180 reversely rotates. With the reverse rotation of the transport rotation shaft 180, the pickup rotation shaft 160 reversely rotates along with the transport gear 182, the idle gear 172, and the pickup gear 162. Accordingly, the pickup roll 100 reversely rotates.

In this way, the recording medium not positioned at the regular position is made to move to the regular position of the recording medium container 92 by the reversely-rotating pickup roll 100.

At this time, the driving force in the reverse rotation direction is not transmitted to the transport roll 102 by the transmission cutoff portion 184 disposed in the transport rotation shaft 180. Accordingly, it is difficult to cause the recording medium to have a posture tilted about the transporting direction, compared with the case not including the configuration according to this exemplary embodiment.

For example, when the pickup roll 100 and the transport roll 102 reversely rotate with the driving force in the state where the leading edge of the recording medium in the transporting direction is pinched between the transport roll 102 and the separation roll 104, the posture of the recording medium may not be stabilized and thus may be tilted about the transporting direction. On the contrary, by causing only the pickup roll 110 to reversely rotate with the driving force and causing the transport roll 102 (and the separation roll 104) to idle, the recording medium can be made to move with an end thereof supported, thereby stabilizing the posture of the recording medium.

The transport roll 102 is made to idle in the reverse rotation direction by the transmission cutoff portion 184 and the separation roll 104 is made to idle in the reverse rotation direction by the rotation control member 104*a*. Accordingly, compared with the case not including the configuration according to this exemplary embodiment, it is easy to cause the recording medium pinched between the transport roll 102 and the separation roll 104 to move to the opposite side in the transporting direction.

Figure 6D:
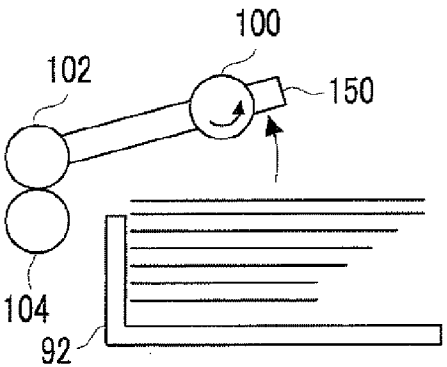

As shown in FIG. 6D and (d) of FIG. 7, the pickup roll 100 reversely rotates by a predetermined number of times so as to cause the recording medium to move to the regular position and then the revolving member 150 revolves in the direction (to the upside in this exemplary embodiment) in which it gets away from the recording medium container 92.

Specifically, the fourth driving gear 228 of the driving mechanism 200 engages with the separation gear 208. Accordingly, the separation gear 208 rotates and the pressing portion 250 rotates with the rotation of the separation gear 208.

When the separation gear 208 rotates and the tip 250*a* of the pressing portion 250 presses the pressing target portion 152 of the revolving member 150, the revolving member 150 revolves upward (moves up). Accordingly, the pickup roll 100 moves to a position where it does not interfere with the traveling of the recording medium passing through the feeding path 112.

When recording media are continuously transported, the revolving member 150 moves up (the pickup roll 100 is separated from a recording medium) in time from the state where a recording medium can be transported by the transport roll 102 and the register roll 122 disposed more downstream in the transporting direction than the transport roll 102.

Figure 6E:
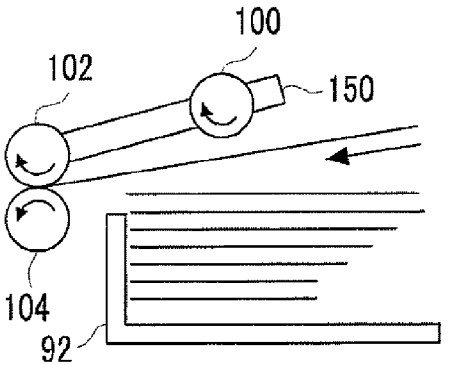

As shown in FIG. 6E and (e) of FIG. 7, the recording medium is fed via the feeding path 112 from the recording medium tray 94 and the recording medium is transported to the image forming section 40 by the transport roll 102 and the separation roll 104.

Specifically, the second driving gear 224 engages with the first driven gear 242 and the first driven gear 242 normally rotates. Accordingly, the normal rotation of the first driven gear 242 and the reverse rotation of the second driven gear 244 are simultaneously performed.

At this time, the transport rotation shaft 180 normally rotates with the rotation of the first driven gear 242.

In this way, in the state where the driving force is continuously transmitted to the pickup roll 100, the pickup roll 100 is switched from the reverse rotation to the normal rotation. Accordingly, compared with the case not including the configuration according to this exemplary embodiment, it is possible to suppress the influence of an external force on the pickup roll 100 when the pickup roll 100 is switched from the reverse rotation to the normal rotation.

For example, in the configuration in which the normal rotational driving force is transmitted after the transmission of the reverse rotational driving force is stopped, no driving force is transmitted in the period of time when the driving force is switched, and thus the pickup roll can be made to rotate with an external force.

Figure 6F:
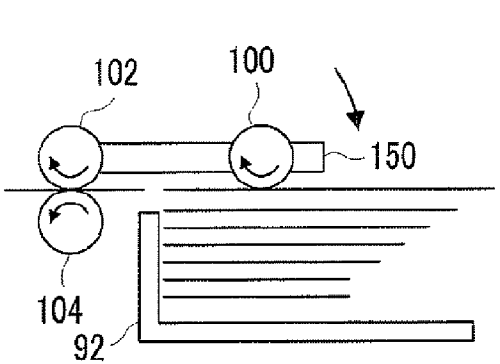

As shown in FIG. 6F and (f) of FIG. 7, the leading edge of the recording medium fed through the feeding path 112 is transported to the transport roll 102 and the separation roll 104 and then the revolving member 150 revolves in the direction (to the downside in this exemplary embodiment) in which it gets close to the recording medium container 92.

Specifically, with the rotation of the separation gear 208 of the driving mechanism 200, the tip 250*a* of the pressing portion 250 exceeds the range where it presses the pressing target portion 152 of the revolving member 150. Accordingly, the revolving member 150 moves down and is returned to the position before it moves up.

The separation gear 208 rotates with the movement of the pressing portion 250 to the initial position by the positioning portion 252.

The revolving member 150 moves to the recording medium container 92 in time so as not to interfere with the traveling of the recording medium transported through the feeding path 112.

In the state where the normal rotation of the first driven gear 242 and the reverse rotation of the second driven gear 244 are simultaneously performed, the third driving gear 226 and the idle driving gear 206 are disengaged from each other and the rotation of the second driven gear 244 is stopped.

Second Exemplary Embodiment

A second exemplary embodiment of the invention will be described below.

Figure 8B:
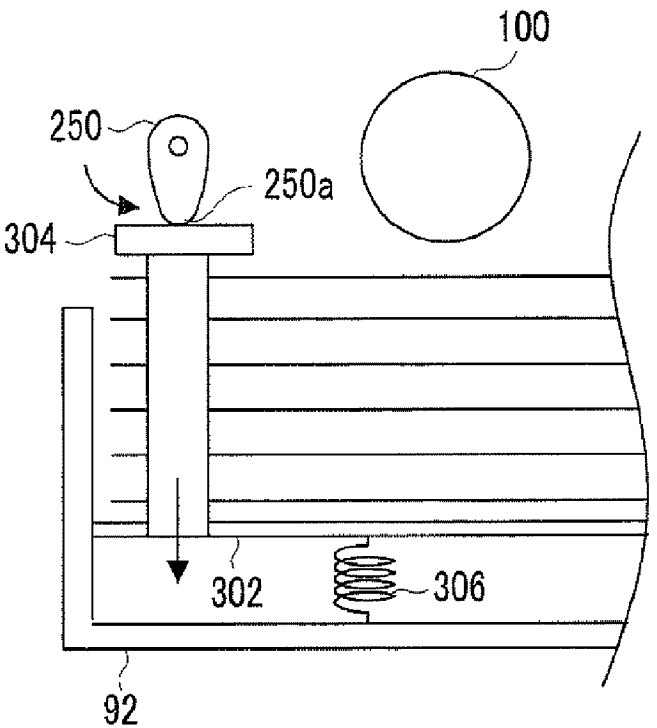
FIGS. 8A and 8B are diagrams schematically illustrating a recording medium feeding device according to a second exemplary embodiment of the invention.
Figure 8A:
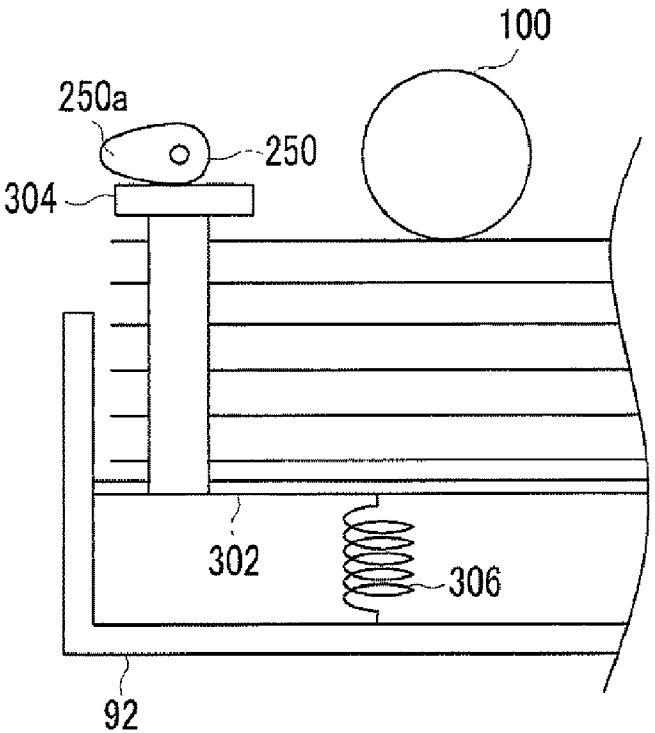

FIGS. 8A and 8B are diagrams schematically illustrating a recording medium feeding device 42 according to the second exemplary embodiment of the invention.

The first exemplary embodiment provides the configuration in which the pressing portion 250 of the separation gear 208 causes the revolving member 150 to revolve, but the second exemplary embodiment provides a configuration in which the pressing portion 250 lowers a stack portion 302 of the recording medium container 92.

The recording medium container 92 includes a stack portion 302 on which recording media are stacked and placed and a pressing target portion 304 is formed in the stack portion 302.

The stack portion 302 is impelled to the pickup roll 100 by the impelling member 306.

In the second exemplary embodiment, the pressing portion 250 is disposed to face the pressing target portion 304 of the stack portion 302.

As shown in FIG. 8A, when the tip 250*a* of the pressing portion 250 does not face the pressing target portion 304, the stack portion 302 is located close to the pickup roll 100 (on the upside in this exemplary embodiment).

As shown in FIG. 8B, when the pressing portion 250 rotates with the rotation of the separation gear 208, the pressing portion 250 faces the pressing target portion 304 (the downside in this exemplary embodiment) and presses the pressing target portion 304. Accordingly, the stack portion 302 is lowered against the impelling force of the impelling member 306.

In the second exemplary embodiment, the pressing portion 250 cause the stack portion 302 to move in the direction in which it gets away from the pickup roll 100, so that recording media (especially, the uppermost recording medium) stacked on the stack portion 302 do not interfere with the traveling of the recording medium passing through the feeding path 112.

The configuration in which the pressing portion 250 of the separation gear 208 causes the revolving member 150 to revolve and the configuration in which the pressing portion 250 lowers the stack portion 302 of the recording medium container 92 may be combined.

In this case, for example, the pressing portion 250 is disposed so as to press the pressing target portion 152 of the revolving member 150 and the pressing target portion 304 of the stack portion 302.

The foregoing description of the exemplary embodiments of the present invention has been provided for the purposes of illustration and description. It is not intended to be exhaustive or to limit the invention to the precise forms disclosed. Obviously, many modifications and variations will be apparent to practitioners skilled in the art. The embodiments were chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. A recording medium feeding device comprising:

a first rotating member that picks up a recording medium;

a second rotating member that transports the recording medium picked up by the first rotating member;

a driving gear unit that rotates and transmits a driving force;

a first transmission mechanism that includes a first gear, wherein, when the driving force of the driving gear unit is transmitted, the first transmission mechanism transmits the driving force in a first rotation direction to the first rotating member and the second rotating member;

a second transmission mechanism that includes a second gear, wherein, when the driving force of the driving gear unit is transmitted, the second transmission mechanism transmits the driving force in a second rotation direction, which is opposite to the first rotation direction, to the first rotating member; and a transmission adjusting portion that transmits a rotation of either one of the first gear or the second gear to either one of the first transmission mechanism or the second transmission mechanism as the driving force, wherein the first gear rotates in the first rotation direction when the first gear engages with the driving gear unit, the second gear rotates in the second rotation direction when the second gear engages with the driving gear unit, and the driving gear unit engages so as to overlap with both the first gear and the second gear within a predetermined range.

2. The recording medium feeding device according to claim 1, wherein the first gear and the second gear are disposed to be coaxial with each other, and the transmission adjusting portion performs a buffering function so as not to transmit the rotation of either one of the first gear or the second gear to either one of the first transmission mechanism or the second transmission mechanism.

3. The recording medium feeding device according to claim 1, wherein the transmission adjusting portion includes an elastic member.

4. The recording medium feeding device according to claim 1, further comprising:

a transmission cutoff portion that cuts off the transmission of the driving force in the second rotation direction to the second rotating member.

5. The recording medium feeding device according to claim 1, further comprising:

a feeding path that passes through between the first rotating member and the recording medium to be picked up by the first rotating member so as to feed the recording medium to the second rotating member; and a separation mechanism that separates the first rotating member from the recording medium to be picked up by the first rotating member.

6. The recording medium feeding device according to claim 5, wherein the separation mechanism separates the first rotating member from the recording medium after the first rotating member rotates in the second rotation direction by a predetermined number of rotations.

7. The recording medium feeding device according to claim 5, further comprising:

a third rotating member that is disposed more downstream in the transporting direction than the second rotating member and that transports the recording medium from the second rotating member downstream in the transport direction, wherein when the recording medium is transported to the third rotating member, the separation mechanism separates the first rotating member from the recording medium after the recording medium picked up by the first rotating member is transported by the second rotating member and the third rotating member.

8. The recording medium feeding device according to claim 5, wherein the separation mechanism includes a separation member that is disposed to rotate along with the driving gear unit and that is non-uniform in distance from a rotation shaft to an end in a normal direction.

9. The recording medium feeding device according to claim 5, further comprising:

a sheet tray on which a recording medium is placed, wherein the first rotating member picks up the recording medium placed on the tray, and the separation mechanism separates the first rotating member from the recording medium to be picked up by the first rotating member by moving the sheet tray in a direction in which the sheet tray gets away from the first rotating member.

10. An image forming apparatus comprising:

an image forming section that forms an image on a recording medium; and a recording medium feeding section that feeds the recording medium to the image forming section, wherein the recording medium feeding section includes:

a first rotating member that picks up a recording medium, a second rotating member that transports the recording medium picked up by the first rotating member, a driving gear unit that rotates and transmits a driving force, a first transmission mechanism that includes a first gear, wherein, when the driving force of the driving gear unit is transmitted, the first transmission mechanism transmits the driving force in a first rotation direction to the first rotating member and the second rotating member, a second transmission mechanism that includes a second gear, wherein, when the driving force of the driving gear unit is transmitted, the second transmission mechanism transmits the driving force in a second rotation direction, which is opposite to the first rotation direction, to the first rotating member, and a transmission adjusting portion that transmits a rotation of either one of the first gear or the second gear to either one of the first transmission mechanism or the second transmission mechanism as the driving force, and wherein the first gear rotates in the first rotation direction when the first gear engages with the driving gear unit, the second gear rotates in the second rotation direction when the second gear engages with the driving gear unit, and the driving gear unit engages so as to overlap with both the first gear and the second gear within a predetermined range.

* * * * *